United States Patent [19]

Takahashi

[11] Patent Number: 4,890,649

[45] Date of Patent: Jan. 2, 1990

[54] FAULTY PICK REMOVAL FOR A MULTIPLE-PHASE LOOM

[75] Inventor: Takao Takahashi, Tokyo, Japan

[73] Assignee: Nissan Motor Company, Limited, Yokohama, Japan

[21] Appl. No.: 171,444

[22] Filed: Mar. 21, 1988

[30] Foreign Application Priority Data

Mar. 23, 1987 [JP] Japan ..... 62-65782

[51] Int. Cl.[4] ..... D03D 49/00

[52] U.S. Cl. ..... 139/116 A; 139/435; 139/450

[58] Field of Search ..... 139/116, 435, 450, 370.2, 139/116 A, 436, 20, 11

[56] References Cited

U.S. PATENT DOCUMENTS

| | | | |
|---|---|---|---|
| 4,502,512 | 3/1985 | Suzuki et al. | 139/435 X |
| 4,635,686 | 1/1987 | Terasaki | 139/116 |
| 4,711,273 | 12/1987 | Kato et al. | 139/450 X |
| 4,730,643 | 3/1988 | Tamatani | 139/116 |
| 4,749,006 | 6/1988 | Miyamoto | 139/370.2 X |

FOREIGN PATENT DOCUMENTS 50-9904 4/1975 Japan .

59-228047 12/1984 Japan .

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

An operation control method of a multiple-phase loom arranged to weave a plurality of fabrics by simultaneously picking weft yarns respectively to a plurality of warp yarn arrays. In this loom operation control method, first the loom is stopped in case mispick is caused in any of the warp yarn arrays. Then, a mispicked weft yarn and a weft yarn normally picked simultaneously with the mispicked weft yarn are removed automatically. Thereafter, detection is made as to whether the mispicked weft yarn and the normally picked weft yarn are present or not in a weft picking channel. Finally, the loom is restarted upon detecting absence of the mispicked weft yarn and the normally picked weft yarn. Accordingly, the loom restart is carried out after completion of removal of the mispicked weft yarn and the like, thereby achieving effective loom operation without operational troubles, thus preventing weaving defects such as heavy filling bar in a woven fabric.

8 Claims, 5 Drawing Sheets

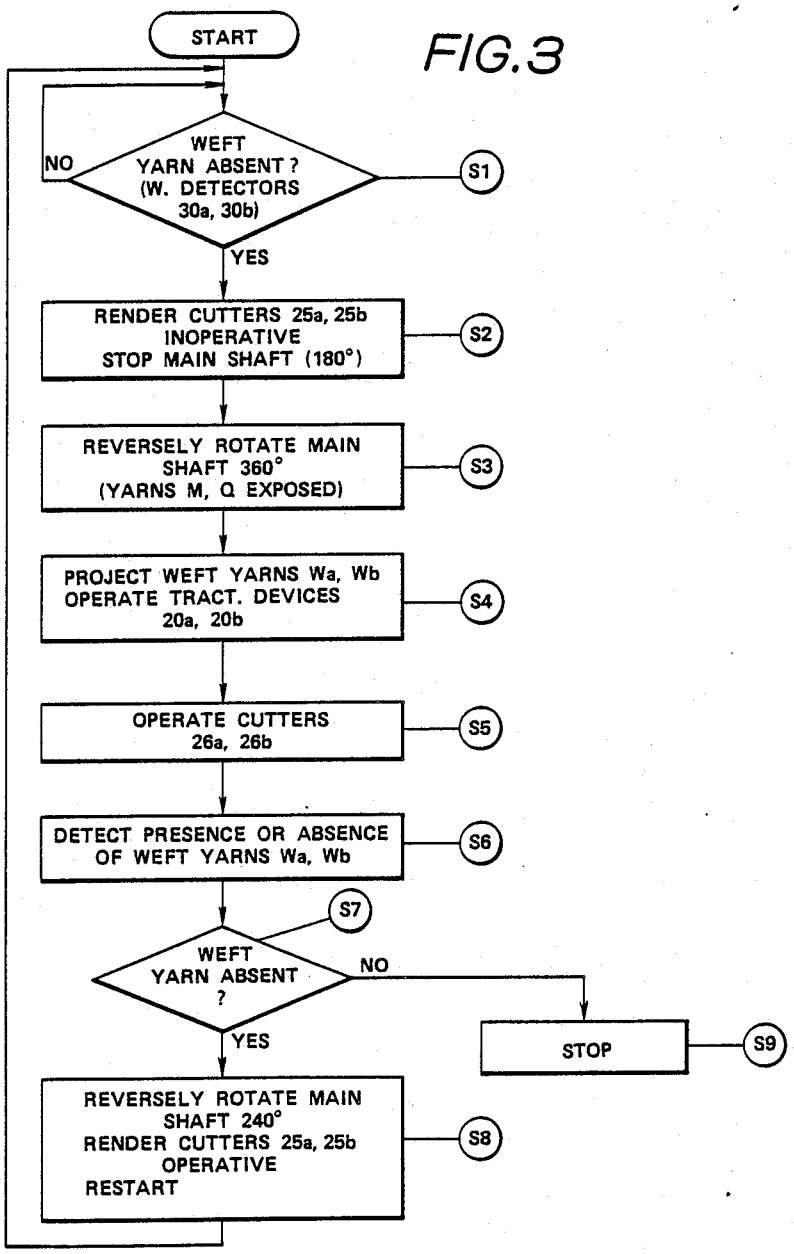
START
FIG. 3
WEFT YARN ABSENT ? (W. DETECTORS 30a, 30b)
NO
YES
S1
RENDER CUTTERS 25a, 25b INOPERATIVE STOP MAIN SHAFT (180°)
S2
REVERSELY ROTATE MAIN SHAFT 360° (YARNS M, Q EXPOSED)
S3
PROJECT WEFT YARNS Wa, Wb OPERATE TRACT. DEVICES 20a, 20b
S4
OPERATE CUTTERS 26a, 26b
S5
DETECT PRESENCE OR ABSENCE OF WEFT YARNS Wa, Wb
S6
S7
WEFT YARN ABSENT ?
NO
YES
STOP
S9
REVERSELY ROTATE MAIN SHAFT 240° RENDER CUTTERS 25a, 25b OPERATIVE RESTART
S8

FAULTY PICK REMOVAL FOR A MULTIPLE-PHASE LOOM

BACKGROUND OF THE INVENTION

1. Field of the Invention

This invention relates to improvements in an operation control method of a multiple-phase weaving loom which weaves a plurality of fabrics located side by side, and more particularly to the multiple-phase weaving loom operation control method in which the loom is restarted after a mispicked weft yarn is completely removed.

2. Description of the Prior Art

A two-phase weaving loom has been proposed to simultaneously weave two fabrics and disclosed, for example, in Japanese Patent Publication No. 50-9904. This two-phase weaving loom uses a broad loom, in which warp yarns passed thereon are divided into two warp yarns arrays. A pair of weft picking nozzles are disposed between these warp yarn arrays and directed oppositely to project weft yarns fed from measuring and storage devices to the respective warp yarn arrays, thereby simultaneously weaving a plurality of fabrics.

With such a loom, when the loom stops owing to mispick caused in one of the warp yarn arrays, the weaving operation in the other warp yarn array having no abnormality is also unavoidably stopped, so that the total operational efficiency of the loom is low. In view of this, for the purpose of raising the loom operational efficiency and thereby to improve production efficiency, it has been required to shorten the loom stopping time for treating a mispicked weft yarn as much as possible by providing to the loom a function of automatically removing the mispicked weft yarn when a mispick occurs.

A loom operation control method for automatically removing a mispicked weft yarn has been already proposed and disclosed, for example, in Japanese Patent Provisional Publication No. 59-228047. This loom operation control method is as follows: When a mispick occurs during weft picking in which a weft yarn is projected from a weft picking nozzle, the loom is stops maintaining a condition where a mispicked weft yarn is being connected to the weft picking nozzle after beating-up the mispicked weft yarn. Subsequently, the mispicked weft yarn is exposed at the cloth fell and removed upon sucking carried out by a weft suction device. Thereafter, the loom is restarted.

Now, assuming that this loom operation control method is applied to the above-mentioned two-phase weaving loom so that the mispicked yarn removing means is provided to each warp yarn array, a mispicked weft yarn can automatically be removed when a mispick occurs in one of the two warp yarn arrays. However, in this case, a weft yarn normally picked simultaneously with the mispicked weft yarn remains unremoved in the other warp yarn array. As a result, in the first weft picking upon loom restart, a new weft yarn is added to the previously picked weft yarn picked in the other warp yarn array in which no mispick occurs. These two weft yarns are woven in the fabric thereby to form a section high in density or a heaving filling bar.

In addition, the mispicked weft yarn and/or the weft yarn normally picked simultaneously with the mispicked weft yarn unavoidably remains unremoved in the warp shed opening also in the case where the mispicked weft yarn has not been removed upon being entangled with the warp yarns and in the case where the mispicked and/or the normally picked weft yarn cannot be removed owing to any trouble of a weft traction device. Thus, in the first weft picking upon loom restart, a newly picked weft yarn is added to the remaining weft yarn similar to above-discussed operation, thereby causing weaving defects such as a heavy filling bar in the woven fabric.

Furthermore, there arises a situation that where a mispick will occur frequently or at every weft picking unless its cause is removed and that a yarn remains unremoved in the warp shed opening at every mispick. This corresponds, for example, to a case where the picked weft yarn is difficult to remove upon being caught by a reed blade to which foreign matter such as waste yarn is attached. In such a case, even weft picking is tried again, the operation of the mispicked weft yarn removing treatment and loom restart must be repeatedly carried out thereby to further prolong the loom stopping time. This will noticeably lower the operation efficiency of the loom.

SUMMARY OF THE INVENTION

An operation control method of the present invention is for a loom of the type wherein a plurality of fabrics are woven by simultaneously picking weft yarns to a plurality of warp yarn arrays. The operation control method comprises the following steps in the order named: stopping the loom in case mispick is made in any of the warp yarn arrays; removing a mispicked weft yarn and a weft yarn which is normally picked simultaneously with the mispicked weft yarn; detecting absence of the mispicked weft yarn and the normally picked weft yarn respectively at predetermined positions; and restarting the loom upon detecting absence of the mispicked weft yarn and the normally picked weft yarn.

According to this loom operation control method, confirmation is made as to whether the mispicked weft yarn and the normally picked weft yarn are removed or not upon detection of the presence or absence of the weft yarns, after completion of removing treatment for the mispicked and normally picked weft yarns. Then, when the absence of the mispicked and normally picked weft yarns is detected, the loom is restarted for the first time. On the contrary, when the presence of the mispicked weft yarn and/or the normally picked weft yarn is detected, treatment such as removing the remaining mispicked weft yarn and the like and repairing troubled parts of the loom will be carried out, maintaining the loom in a stopping condition.

Thus, the present invention enables multiple-phase weaving looms to accomplish effective automatic loom operation without any operational trouble by restarting the loom upon confirmation of the fact that the mispicked weft yarn and/or the simultaneously normally picked weft yarn is not present in the warp shed opening. Furthermore, since the mispicked and the normally picked weft yarn are simultaneously removed, weaving defects such as a heavy fillying bar caused by the fact that the mispicked weft yarn and/or the normally picked weft yarn remaining in the warp shed opening is woven in the fabric. Additionally, in the case where mispick is of the type wherein yarn will remain in the warp shed opening even if weft picking is again tried, the cause of the mispick can be removed before mispick frequently occurs, thereby avoiding a condition where loom stopping time increases due to repeatition of operation of mispicked weft yarn removal treatment and loom restart. This effectively improves operational efficiency of the loom.

BRIEF DESCRIPTION OF THE DRAWINGS

FIG. 3 is a flow chart of an example of the loom operation control metod according to the present invention.

DETAILED DESCRIPTION OF THE INVENTION

Figure 1:
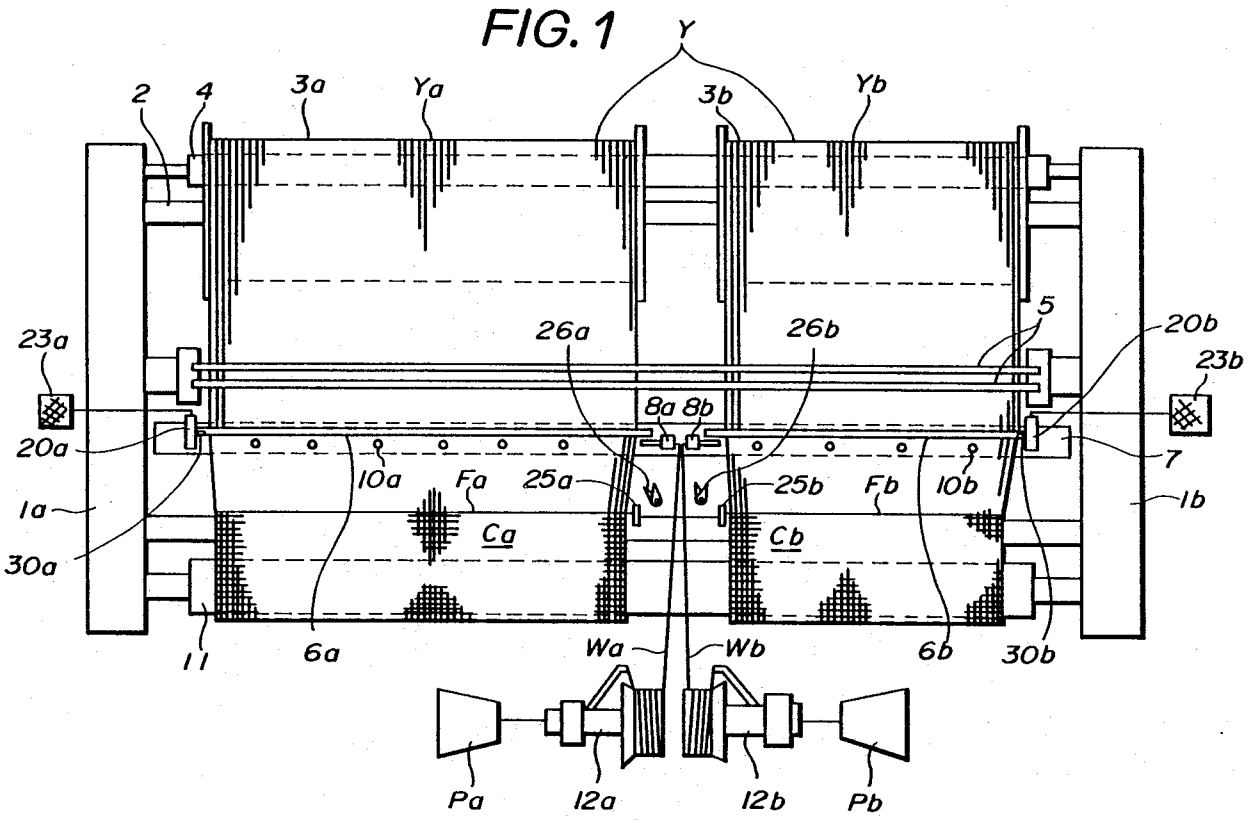
FIG. 1 is a schematic plan view of an example of a multiple-phase weaving loom which carrys out a loom operation control method according to the present invention.

Referring now to FIG. 1, there is shown a two-phase weaving air jet loom or broad loom which is arranged to be operated in accordance with an operation control method of the present invention. The loom is provided with side frames 1a, 1b for supporting a beam shaft 2 extending laterally. Yarn beams 3a, 3b are mounted on the beam shaft 2 and rotated at a low speed by using respective warp let-off motions (not shown), so that a warp yarn row Y wound on the yarn beams 3a, 3b are fed out. The warp yarn row Y is divided into two warp yarn arrays Ya, Yb which are separate from each other by a predetermined distance. The warp yarn arrays Ya, Yb are passed on a common tension roll 4 and turned generally horizontally in an advancing direction and then subjected to a shedding motion by common healds 5. The warp yarn arrays 3a, 3b thereafter pass respective reeds 6a, 6b and reach the cloth fells Fa, Fb of respective woven fabrics Ca, Cb. The woven fabrics Ca, Cb are turned downwardly by a breast beam 11 and taken up on a cloth roller (not shown) located downward of the breast beam 11.

Figure 2:
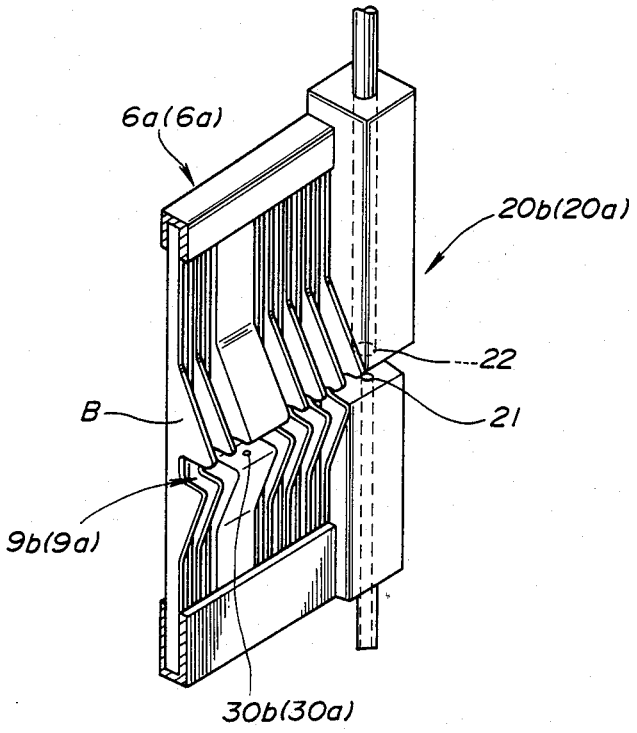
FIG. 2 is an enlarged perspective view of a reed and air guide system of the loom shown in FIG. 1

The reeds 6a, 6b are attached to a common reed holder 7 in such a manner that their location is adjustable. Weft picking or air ejection nozzles 8a, 8b are fixed onto the reed holder 7 and located between the warp yarn arrays Ya, Yb. In other words, the weft picking nozzles 8a, 8b are disposed between the inner edges of the respective warp yarn arrays Ya, Yb, As shown in FIG. 2, each reed 6a, 6b is formed at its front section with an air guide channel 9a, 9b which is constituted by a groove formed in each reed blade B of the reed 6a, 6b. Additionally, a plurality of auxiliary (air ejection) nozzles 10a, 10b are provided immediately in front of the air guide channel 9a, 9b and constitute an air guide system known per se in combination with the above-mentioned air guide cannel 9a, 9b.

So-called drum type weft measuring and storage devices 12a, 12b are provided in such a manner that each device 12a, 12b is located between a weft package Pa, Pb and the weft picking nozzle 8a, 8b, so that a weft yarn Wa, Wb is introduced through the device 12a, 12b to the weft picking nozzle 8a, 8b.

Weft traction devices 20a, 20b are disposed respectively on counter-weft picking sides for the warp yarn arrays Ya, Yb. As clearly shown in FIG. 2, each weft traction device 20a, 20b has first and second air passages 21, 22 between which the air guide channel 9a, 9b is formed, so that the first air passage 20a opens at its upper end to the air guide channel 9a, 9b while the second air passage 22 opens at its lower end to the air guide channel 9a, 9b. The first air passage 21 is fluidly connected to a pressurized air source through mechanical valves, solenoid valves and the like though not shown. The second air passage 22 is fluidly connected to netting baskets 23a, 23b and adapted to suck the weft yarn Wa, Wb upon receiving air stream ejected from the first air passage 21 under operation of the above-mentioned valves.

Cutters 25a, 25b for ordinary use are disposed near the inner edge of woven cloths Ca, Cb which edge is on the side of the weft picking nozzle 8a, 8b. The woven cloths Ca, Cb correspond to the warp yarn arrays Ya, Yb, respectively. Thus, the cutters 25a, 25b are adapted not to cut the weft yarns Wa, Wb when mispick has been made. Additional cutters 25a, 25b are provided near the edge (on the side of the weft picking nozzle) of the woven fabrics, Ca, Cb and adapted to advance to the vicinity of the weft picking nozzles 8a, 8b at a predetermined timing for the purpose of cutting the weft yarns when mispick has been made.

As shown in FIG. 2, weft detectors 30a, 30b of the photoelectric type are respectively disposed at the end sections on the downstream sides of the air guide channels 9a, 9b and located between the adjacent reed blades B, B. Each weft detector 30a, 30b is adapted to detect as to whether the weft yarn Wa, Wb is present or not in position at the terminal period of weft picking and at a predetermined timing in the case where mispick has been made.

The operation of the above-mentioned air jet loom will be discussed hereinafter with reference to a flow chart of FIG. 3 and FIGS. 4A to 4F on the assumption that the rotational angle of a loom main shaft (not shown) is 0° at the timing of beating-up with the reed. The operation of the loom is in timed relation to the loom main shaft.

First the basic weaving operation will be explained. When the loom starts, the loom main shaft rotates to drive warp yarn arrays Ya, Yb. Then, pressurized air is ejected through the weft picking nozzles 8a, 8b to project the weft yarns Wa, Wb, thereby accomplishing weft pickings through the sheds of the warp yarn arrays Ya, Yb. The ends of the weft yarns Wa, Wb which have passed to the counter-weft picking sides are drawn respectively to the weft traction devices 20a, 20b during which beating-up with the reeds 6a, 6b are carried out. During this beating-up, the weft detectors 30a, 30b detect as to whether the weft yarns Wa, Wb are present or absent, thus watching the fact that mispick of the weft yarns Wa, Wb has occurred or not (See a step S1 of FIG. 3). Thereafter, the cutters 25a, 25b cut the respective picked weft yarns Wa, Wb. The above operation will be repeated.

Figures 4A, 4B, 4C:
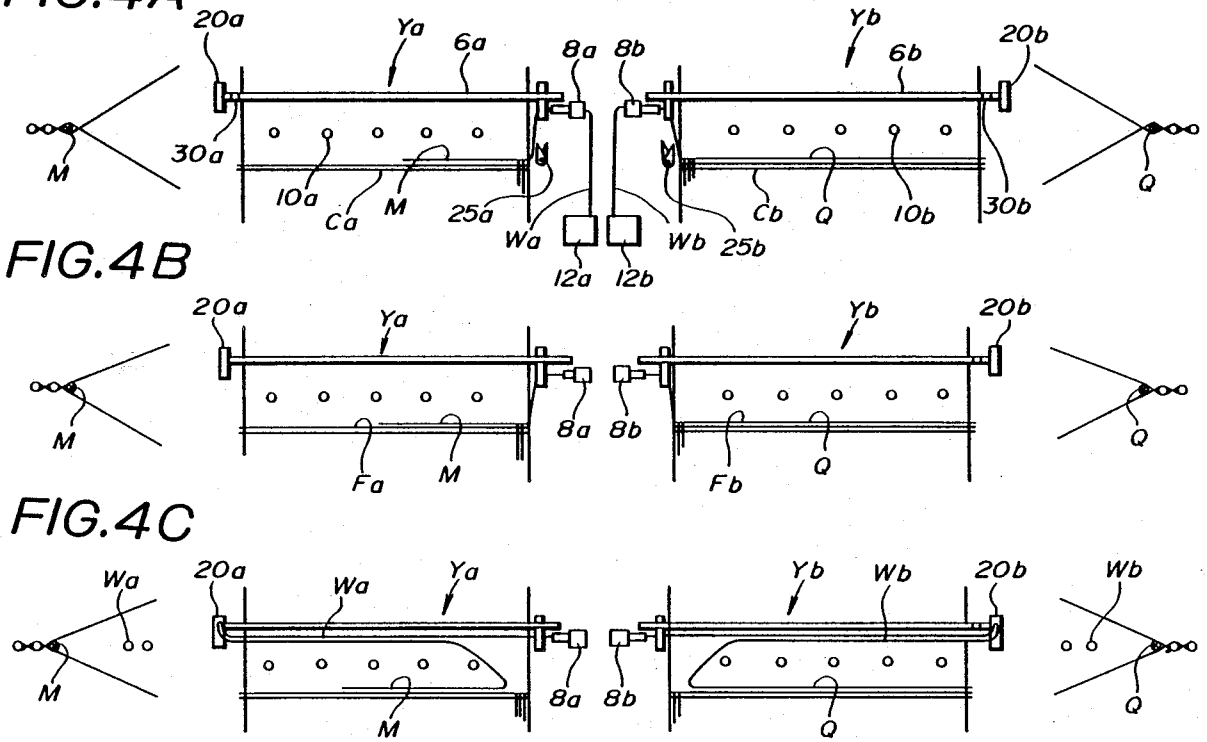
FIGS. 4A to 4F are schematic illustrations showing a process of removing a mispicked weft yarn and a normally picked weft yarn picked simultaneously with the mispicked weft yarn.

During the above-mentioned normal weaving operation, for example when the weft yarn Wa is broken accidentally in the warp yarn array Ya thereby to cause mispick as shown in FIG. 4A, the weft detector 30a detects the fact that weft yarn is absent and outputs a signal representing this fact. In response to this signal, the cutters 25a, 25b are kept in an inoperative condition, and the loom main shaft is stopped (See steps S2 and S3 of FIG. 3). In this case, the loom main shaft is stopped at 180° (the maximum shedding state of the warp yarns) in the next loom operational cycle after the beating-up, taking account of inertial motion. As a result, a mispicked weft yarn M for the warp yarn array Ya and a normally picked weft yarn Q which is picked simultaneously with the yarn M and for the warp yarn array Yb are respectively being connected to the weft picking nozzles 8a, 8b.

Subsequently, as shown in FIG. 4B, the loom main shaft is reversely rotated by 360° to establish a state in which the mispicked weft yarn M and the normally picked weft yarn Q are respectively exposed at the cloth fells Fa, Fb of the woven fabrics Ca, Cb (See a step S3 of FIG. 3).

Next, as shown in FIG. 4C, air is ejected through the weft picking nozzles 8a, 8b, and the weft traction devices 20a, 20b are operated, supplying the weft yarns from the weft measuring and storage devices 12a, 12b (See a step S4 of FIG. 3). This results in the fact that the weft yarns Wa, Wb connected respectively to the mispicked weft yarn M and the normally picked weft yarn Q are projected generally in the U-shape into the shed opening of the warp yarns under the influence of air ejected from the weft picking nozzles 8a, 8b. When the tip end sections of these projected weft yarns Wa, Wb reach the respective weft traction devices 20a, 20b, supply of the weft yarns Wa, Wb is stopped so that the weft yarns Wa, Wb are drawn respectively into the weft traction devices 20a, 20b. Then, as shown in FIG. 4C, the mispicked weft yarn M and the normally picked weft yarn Q are gradually peeled off from the respective cloth fells Fa, Fb, maintaining its V-shape opened toward the counter-weft picking side. Finally, the weft yarn Wa, Wb is extended straightly between the weft picking nozzle 8a, 8b and the weft traction device 20a, 20b.

Figure 4D:
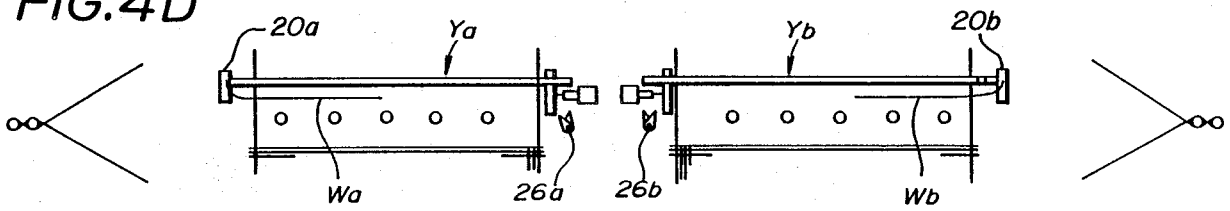

Subsequently, the cutters 26a, 26b are operated (See a step S5 of FIG. 3) thereby to cut the respective weft yarns Wa, Wb in the vicinity of and on the immediately downstream side of the respective weft picking nozzles 8a, 8b. Then, as shown in FIG. 4D, the cut weft yarns Wa, Wb are drawn respectively to the weft traction devices 20a, 20b and discarded to the netting baskets (not shown).

Figure 4E:
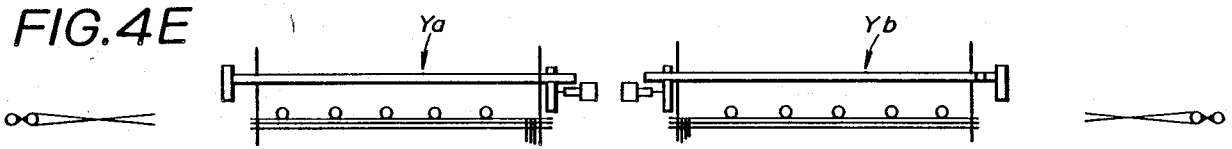
Figure 4F:
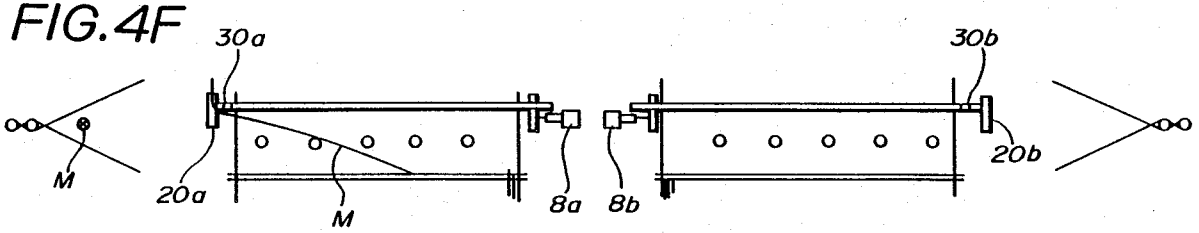

Thereafter, the weft detector 30a, 30b detect as to whether the weft yarns Wa, Wb are present or not (See steps S6 and S7 of FIG. 3). In this case, the fact that no weft yarn is present is detected, so that the flow of the flow chart goes to the next step upon confirmation that removal of the mispicked weft yarn M and the picked weft yarn Q are normally carried out. That is to say, as shown in FIG. 4E, the loom main shaft is rotated reversely by 240° so as to be brought into coincidence with 300° (loom strating position) in the loom operational cycle before mispick is made, and the cutters 25a, 25b are made operative to establish a state for weft picking. Under this condition, the loom is restarted (See a step S8 of FIG. 3).

In the case where the mispicked weft yarn M cannot be removed and remains in the shed opening of the warp yarns even upon the above-discussed removal treatment, for example, for the reason why the weft yarn is entangled with warp yarns, the weft detector 30a detects the fact that the weft yarn is present and therefore restart of the loom is prohibited upon decision that abnormality occurs, so that the loom stops in this state (see a step S9 of FIG. 3). Additionally, the weft detectors 30a, 30b detect the fact that the weft yarn is present thereby to put the loom into a stopping condition also in case where the weft yarn cannot be removed upon being entangled with the reed blades or the like to which foreign matters such as waste yarn is attached or in case where the weft traction device 20a, 20b is out of order in which the projected weft yarn remains in the warp shed opening without being drawn to the weft traction device 20a, 20b.

While detection that the mispicked weft yarn M and the picked weft yarn Q have been removed has been shown and described as being made on the counter-weft picking side in the above-discussed loom, it will be understood that the detection is not limited as being made on the counter-weft picking side so that such detection may be made, for example, by a separate weft detector disposed on the weft picking side or at the cloth fells Fa, Fb. Thus, the location at which such detection is made may be suitably altered. Although the removal of the mispicked weft yarn M and the normally picked weft yarn Q has been shown and described as to be carried out from the counter-weft picking side, it will be understood that the removal may be carried out from the weft picking side. Furthermore, it will be appreciated that the principle of the present invention is applicable to a variety of looms other than air jet looms.

What is claimed is:

1. An operation control method of a loom of a type wherein a plurality of fabrics are woven by simultaneously picking weft yarns respectively to a plurality of warp yarn arrays, said method comprising the following steps in the order named:

stopping the loom in case a mispick is made in any of the warp yarn arrays;

removing a mispicked weft yarn in the warp yarn array and a weft yarn which is normally picked in another warp yarn array simultaneously with said mispicked weft yarn;

detecting an absence of said mispicked weft yarn and said normally picked weft yarn respectively at predetermined positions; and restarting the loom upon detecting the absence of said mispicked weft yarn and said normally picked weft yarn.

2. An operation control method as claimed in claim 1, further comprising the step of detecting presence of said mispicked weft yarn and said normally picked weft yarn at predetermined positions, and the step of maintaining the stopping condition of the loom upon detection of presence of at least one of said mispicked weft yarn and said normally picked weft yarn.

3. An operation control method as claimed in claim 1, wherein the removing step includes the step of automatically removing said mispicked weft yarn and said normally picked weft yarn.

4. An operation control method as claimed in claim 1, wherein the removing step includes the step of simultaneously removing said mispicked weft yarn and said normally picked weft yarn.

5. A multiple-phase weaving loom of a type wherein a plurality of fabrics are woven by simultaneously picking weft yarns respectively to a plurality of warp yarn arrays, said loom comprising:

means for stopping the loom in case a mispick is made in any of the warp yarn arrays;

means for removing a mispicked weft yarn in the warp yarn array and a weft yarn which is normally picked simultaneously in another warp yarn array with said mispicked weft yarn after stopping of the loom;

means for detecting an absence of said mispicked weft yarn and said normally picked weft yarn respectively at predetermined positions after removing said mispicked and normally picked weft yarns; and means for restarting the loom upon detecting the absence of at least one of said mispicked weft yarn and said normally picked weft yarn.

6. A multiple-phase weaving loom as claimed in claim 5, further comprising means for maintaining the loom in stopping condition upon detecting presence of at least one of said mispicked weft yarn and said normally picked weft yarn.

7. A multiple-phase weaving loom as claimed in claim 5, wherein said removing means includes means for automatically removing said mispicked weft yarn and said normally picked weft yarn.

8. An operation control method of a loom of a type wherein a plurality of fabrics are woven by simultaneously picking weft yarns respectively to a plurality of warp yarn arrays, said method comprising the following steps in the order named:

stopping the loom in case a mispick is made in any of the warp yarn arrays;

simultaneously removing a mispicked weft yarn in the warp yarn array and a weft yarn which is normally picked simultaneously in another warp yarn array with said mispicked weft yarn;

detecting an absence of said mispicked weft yarn and said normally picked weft yarn respectively at predetermined positions; and restarting the loom upon detecting the absence of said mispicked weft yarn and said normally picked weft yarn.

* * * * *